US005325932A

United States Patent [19]

Anderson et al.

[11] Patent Number: 5,325,932

[45] Date of Patent: Jul. 5, 1994

[54] DOWN REAMING APPARATUS

[75] Inventors: Llewellan Anderson, Renton; Brian W. Kelley, Kent; Larry F. Rowe, Federal Way; Thomas C. Whitehouse, Puyallup, all of Wash.

[73] Assignee: The Robbins Company, Redmond, Wash.

[21] Appl. No.: 859,321

[22] Filed: Mar. 27, 1992

[51] Int. Cl.[5] ..... E21B 7/28; E21B 17/10; B60C 17/04

[52] U.S. Cl. ..... 175/325.3; 175/53; 301/39.1

[58] Field of Search ..... 175/53, 86, 94, 95, 175/96, 219, 325.3, 320; 166/241.6; 301/36.1, 36.3, 39.1, 40.2

[56] References Cited

U.S. PATENT DOCUMENTS

| | | | |
|---|---|---|---|
| 2,049,268 | 7/1936 | Ludwick | 301/39.1 X |
| 3,383,946 | 5/1968 | Justman | 175/320 X |
| 3,840,272 | 10/1974 | Crane et al. | 299/56 |
| 3,965,995 | 6/1976 | Sugden | 175/57 |
| 3,999,616 | 12/1976 | Crane et al. | 173/32 |
| 4,009,909 | 3/1977 | Robbins et al. | 299/56 |
| 4,270,618 | 6/1981 | Owens | 175/57 |
| 4,646,853 | 3/1987 | Sugden et al. | 175/94 |
| 5,199,515 | 4/1993 | Sinclair et al. | 175/213 |

FOREIGN PATENT DOCUMENTS

| | | | |
|---|---|---|---|
| 628306 | 10/1978 | U.S.S.R. | 175/325.3 |

*Primary Examiner*—David J. Bagnell

*Attorney, Agent, or Firm*—Graybeal Jackson Haley & Johnson

[57] ABSTRACT

A down remaining apparatus has an upper stabilizer which supports the down reaming apparatus in the bored hole. A plurality of wheel assemblies are radially attached to the hub of the upper stabilizer. Each of the wheel assemblies has rotatable tires oriented against the bored hole wall, and a rotatable overload wheel which contacts the tunnel wall upon compression of the tires. A weight assembly comprising a plurality of stacked plates is secured to the frame of the down reaming apparatus and has manways therethrough which allow passage of workers. A lower stabilizer provides additional support for the down reaming apparatus. A plurality of wheel assemblies are radially attached to the hub of the lower stabilizer. Each of the wheel assemblies has a rotatable wheel pivotally attached to the lower stabilizer hub and spaced therefrom by a compressible bumper which reacts against the bored hole wall to stabilize the down reaming apparatus.

28 Claims, 18 Drawing Sheets

DOWN REAMING APPARATUS

BACKGROUND OF THE INVENTION

The invention is in the field of rock boring machines, and more specifically such machines for reaming substantially vertical holes, or holes at a slight angle from true vertical, by initiating rock boring at ground level and boring a predetermined distance underground. No known down reaming apparatus is capable of boring substantially larger holes (preferably having a diameter of at least four meters) in a substantially continuous manner.

U.S. Pat. No. 3,965,995 issued to Sugden discloses a machine for boring a large diameter blind hole in a sequential, non-continuous manner. The cutterwheel is mounted at the lower end of the machine for rotation about a horizontal tubular support. A gripper assembly secures the machine against the tunnel wall while thrust cylinders thrust the rotatable cutterhead downwardly. As the machine is advanced, the cutterwheel is rotated to make a first cut in the shape of the leading portion of the cutterwheel. The cutterwheel is then retracted out from the cut and is rotated about the axis of the hole. This repositions the cutterwheel so that when it is advanced again, during the next cutting step, it will make a second cut which crosses the first This procedure is repeated until the desired cross-sectional configuration (e.g. circular) of the hole is obtained The above described sequential boring method employing a gripper assembly and thrust cylinders has been found to be time consuming and requires a complex and expensive machine. U.S. Pat. No. 3,965,995 lists numerous prior art shaft forming machines, the disclosures of which are incorporated herein by reference.

U.S. Pat. No. 4,270,618 issued to Owens teaches an earth boring apparatus which is used for boring a blind pilot hole of a relatively small diameter which is subsequently enlarged by raise boring. Initially, the earth boring apparatus is employed to bore a blind pilot hole. Then the apparatus is removed from the hole and a room is blasted at the blind end of the hole. Next, the pilot hole cutterhead is replaced by a reamer and the apparatus is again inserted into the hole. The reamer is an adjustable diameter type and its diameter is increased once it is within the blasted room. The diameter of the reamer is increased by a plurality of cutter carrying arms which swing outwardly from the axis of rotation of the reamer. The earth boring apparatus is then raised from the room upwardly towards the ground surface to bore a hole of the desired diameter.

Similarly, U.S. Pat. No. 4,646,853 issued to Sugden et al. discloses a shaft boring machine having step-wise operation. The machine includes a cutterwheel assembly having a substantially horizontal axis of rotation and having multiple peripherally mounted roller cutter units. Motors are provided for rotating the cutterwheel assembly about its horizontal axis. A cutterwheel carriage and vertical guide columns support the cutterwheel assembly and allow movement of the cutterwheel assembly in a vertical plane. A base frame supports the vertical guide columns. The base frame is slewed in a substantially horizontal plane by a slew drive system. Plunge cylinders mounted on the cutterwheel carriage and the base frame lower and raise the cutterwheel assembly in a vertical plane. A lower gripper ring stabilizes the machine in the shaft and includes a circular track for supporting the base frame and further includes a lower gripper cylinder system for holding the gripper ring stationary in the shaft. An upper gripper ring provides further stabilization of the machine in the shaft and includes an upper gripper cylinder system for holding the upper gripper ring stationary in the shaft. Walking cylinders are mounted on the lower and upper gripper rings for raising and lowering the rings. U.S. Pat. No. 4,646,853 discloses additional prior art patents pertaining to shaft boring machines, the U.S. patent disclosures of which are incorporated herein by reference.

U.S. Pat. No. 4,270,618 issued to Owens cites prior art patents for drilling machines located at an upper level which bore a large diameter hole in a single downward pass, drilling machines at an upper level which first drill a small pilot hole on a single downward pass and then enlarge the pilot hole in a single upward pass, and machines having expandable reamers. These prior art patents are incorporated herein by reference.

U.S. Pat. No. 3,840,272 issued to Crane et al.; U.S. Pat. No. 3,999,616 issued to Crane et al.; U.S. Pat. No. 4,009,909 issued to Robbins et al.; and patents cited therein disclose machines for upward tunneling, as opposed to down reaming.

A need thus exists for a down reaming apparatus capable of boring a large diameter hole in a substantially continuous manner.

A need also exists for this type of down reaming apparatus which is stabilized in the bored shaft by means of non-gripping stabilizer assemblies having rotatable elements which allow vertical movement of the down reaming apparatus within the tunnel.

A need also exists for this type of down reaming apparatus in which a gear assembly is employed to multiply the torque transmitted from the drill string to the cutterhead.

A need also exists for this type of down reaming apparatus in which a weight assembly is secured on the frame of the down reaming apparatus such that loads from rotation of the cutterhead are transmitted through the frame and into the weight assembly.

A need also exists for this type of down reaming apparatus in which the weight stack has a manway therethrough for access by workers to the cutterhead for cutterhead repair and/or reconfiguration.

A need also exists for this type of down reaming apparatus of this type in which the cutterhead diameter can be increased by the addition of a single spacer having a cutter assembly thereon.

SUMMARY OF THE INVENTION

A down reaming apparatus attached to a drill string includes a frame and a rotatable cutterhead. Support for the down reaming apparatus in the tunnel is provided by an upper stabilizer and a lower stabilizer. The upper stabilizer includes an upper stabilizer hub circumferentially disposed around the drill string such that the drill string rotates relative to the upper stabilizer hub. A plurality of wheel assemblies are radially attached to the upper stabilizer hub. Each of the wheel assemblies has rotatable tires adapted to be oriented against the tunnel wall and a rotatable overload wheel which contacts the tunnel wall to stabilize the down reaming apparatus upon compression of the tires.

The lower stabilizer provides additional support for the down reaming apparatus and includes a lower stabilizer hub below the cutterhead such that the cutterhead rotates relative to the lower stabilizer hub. A plurality of wheel assemblies are radially attached to the lower stabilizer hub. Each of the wheel assemblies has a wheel support pivotally attached to the lower stabilizer hub and spaced therefrom by a compressible bumper. The rotatable wheel on the wheel support reacts against the tunnel wall to stabilize the down reaming apparatus.

The weight assembly, comprising a plurality of stacked plates, is secured to the frame of the rock boring apparatus by a plurality of tie rods such that loads from boring with the cutterhead are transmitted through the frame and into the weight assembly. Manways in the weight assembly allow passage of workers therethrough.

In the preferred embodiment of the present invention the upper stabilizer includes six wheel assemblies having removable extensions to accommodate tunnels of varied diameter. Each of the wheel assemblies is comprised of one overload wheel between two compressible tires. Additionally, a torque multiplier assembly is located in the stabilizer hub and includes a rotatable input shaft attached to the drill string. A sun gear meshes with the input shaft, planet gears mesh with the sun gear and are supported by a planet carrier and a ring gear meshes with the planet gears. A rotatable output shaft either meshes with the ring gear while the planet carrier is held stable, or meshes with the planet carrier while the ring gear is held stable, to produce a torque component greater than that of the input shaft.

Preferably, each of the plates of the weight assembly is comprised of a plurality of wedge shaped sections which are radially offset from the adjoining layer of plates. Additionally, the plurality of tie rods are secured through the weight plates by a top plate brace, a bottom plate brace, and jacks which apply a compressive force against the plates to brace them on the frame of the down reaming appartus.

Preferably, the cutterhead of the down reaming apparatus includes a cutterhead body and a plurality of arms radially disposed on the cutterhead body with cutter assemblies on each arm. Each arm is of a different length and the arms are oriented on the cutterhead body such that the lengths of the arms are successively decreased by the same amount from each arm to the next. A plurality of arm extenders having assemblies thereon are oriented in a first position in which each of the arm extenders is attached to one of the arms such that the combined length of each arm and the attached arm extender is substantially equal. To increase the diameter of the cutterhead, a spacer having a cutter assembly is attached to the shortest of the arms and each of the arm extenders is relocated from its first position to a second position on one of the arms that is adjacent to the arm on which the arm extender was attached in the first position. In this manner, the combined length of each of the arms and attached arm extender in the second position is substantially equal, and is greater than the combined length of each of the arms and attached arm extender in the first position, thus increasing the diameter of the cutterhead. To increase the diameter of the cutterhead further, an additional spacer, or spacers, in conjunction with additional relocation of the arm extenders to a position on an adjacent arm is employed. The cutterhead also includes a plurality of cutter assemblies repositionable on the cutterhead at a plurality of locations between the radially disposed arms to balance the cutterhead. Preferably, five radially disposed arms are located on the cutterhead.

BRIEF DESCRIPTION OF THE DRAWINGS

These and other features of the present invention will be evident when considered in light of the following specification and drawing in which.

DETAILED DESCRIPTION OF THE PREFERRED EMBODIMENT

The present invention pertains to an apparatus for reaming, or boring, holes in rock. These holes are preferably substantially vertical holes but may also be oriented at a slight angle from true vertical. More particularly the present invention pertains to down reaming of relatively large holes through rock. The term down reaming pertains to the method of rock boring in which the reaming apparatus initiates rock boring downwardly, as opposed to raise boring in which the apparatus initiates boring a predetermined distance below ground level and is raised towards the earth's surface. The preferred system of down reaming employing the present invention contemplates first boring a relatively small hole (having a diameter of between about nine and fourteen inches) downwardly from the ground surface, or from an underground level, to a predetermined distance therebelow with an apparatus generally known in the art. Next, this initial down hole is expanded to a pilot hole (having a diameter of preferably between about two meters and four meters) by employing a raise boring apparatus known in the art. Finally, this pilot hole is expanded (preferably to a diameter of between about four meters and eight meters) by boring downwardly through this pilot hole from the ground surface to a predetermined location therebelow with a down reamer according to the present invention.

Figure 1:
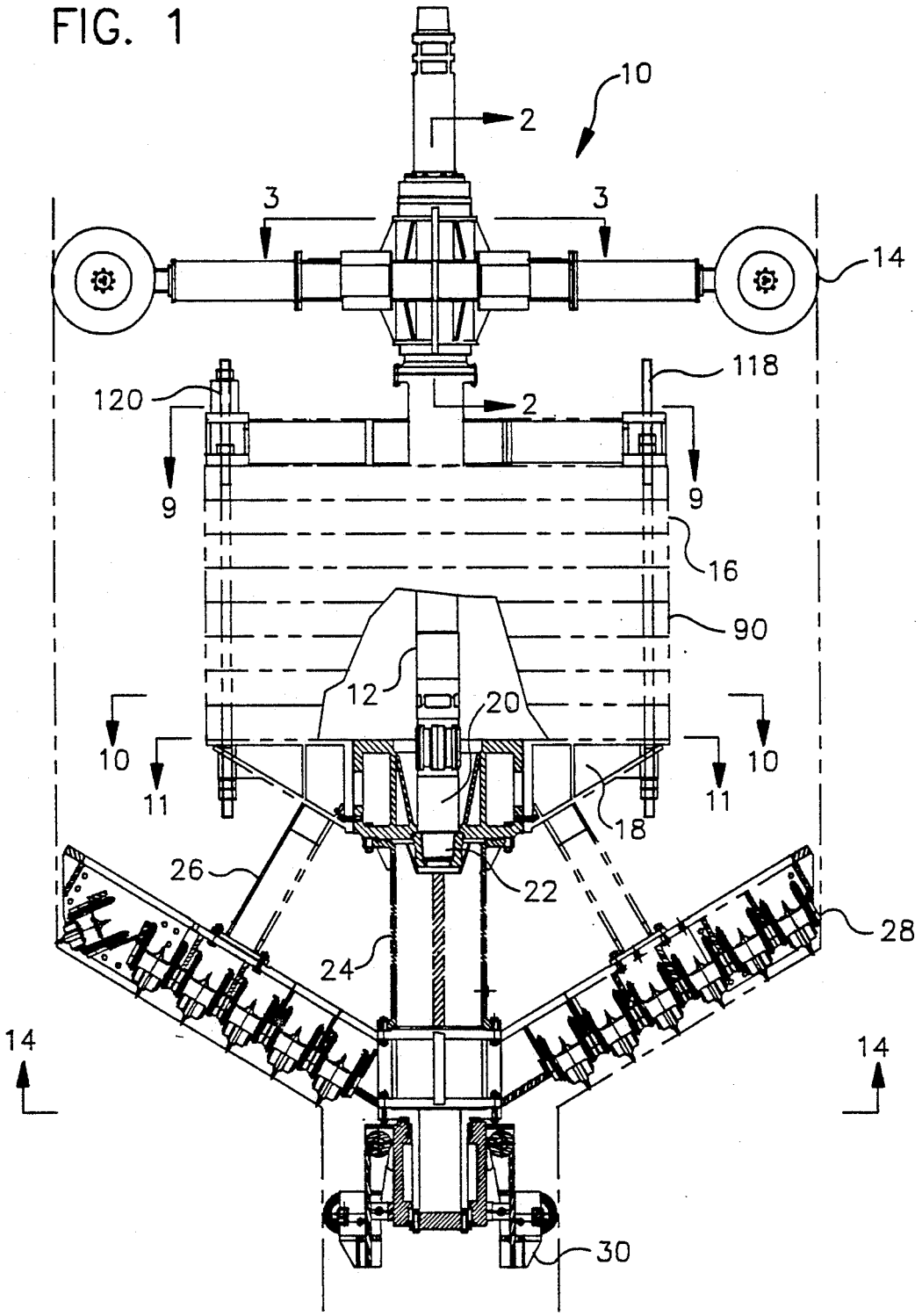
FIG. 1 is a side elevational view, partially in section, of a down boring apparatus typifying the present invention.

Referring to FIG. 1, such a down reamer 10 is secured to drill string 12 so that various elements of down reamer 10 as described herein rotate with drill string 12 while other elements of down reamer 10 are immobile relative to drill string 12. Drill string 12, which is rotated by a motor means known in the art, passes downwardly through upper stabilizer 14 and weight plates 16. Weight plates 16 are supported by spider 18, and the lower end of drill string 12, designated as stinger 20, passes into spider 18 and is fixedly secured in box insert 22 of spider 18. Torque tube 24 and spider support arms 26 are fixedly secured to the underside of spider 18 and to the upper portion of cutterhead 28. Lower stabilizer 30 is located directly under the central portion of cutterhead 28. As drill string 12 is rotated, upper stabilizer 14 and lower stabilizer 30, being braced against the wall of the bored hole, do not rotate with the drill string 12. Weight plates 16, spider 18, torque tube 24, spider support arms 26, and cutterhead 28 all rotate with drill string 12 in order to facilitate down reaming, with the boring of rock by cutterhead 28 augmented by the downward force applied thereon by the mass of weight plates 16.

Figure 2:
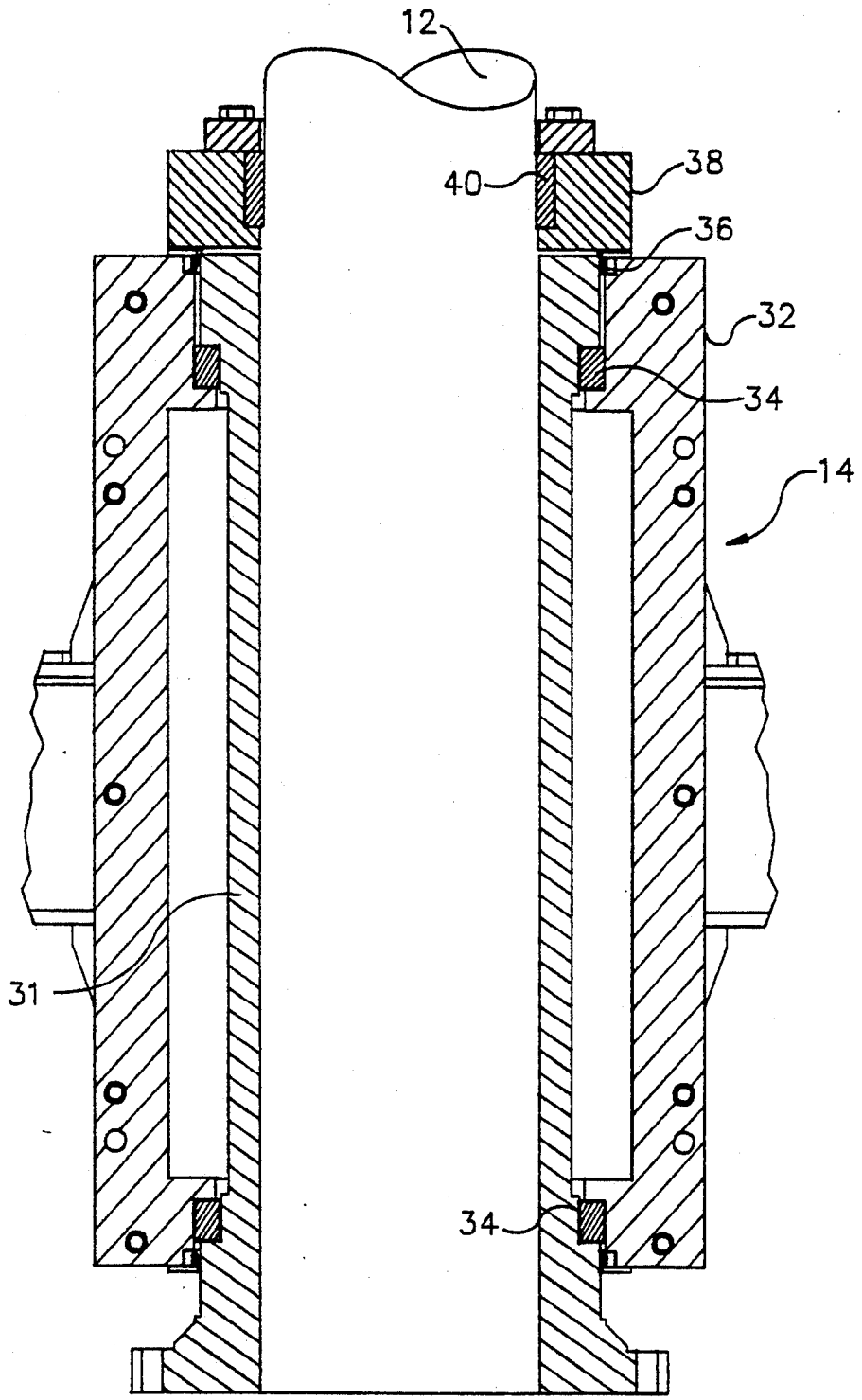
FIG. 2 is an enlarged cross-sectional view of the upper stabilizer hub of the down boring apparatus of FIG. 1 taken along lines 2—2.

Referring now to FIG. 2, the attachment of upper stabilizer 14 onto drill string 12, which allows relative rotation of drill string 12 and inner race 31 with respect to upper stabilizer 14, is now described in detail. Upper stabilizer hub 32 has stabilizer bearings 34 located at each end thereof. Stabilizer bearings 34 allow relative rotation of drill string 12 and inner race 31 with respect to upper stailizer 14. Upper stabilizer 14 is preferably divided into two halves which are joined around drill string 12 and connected by fastening means such as bolts or the like. The inner race 31 located adjacent the upper portion of upper stabilizer hub 32 has an annular seal 36 located therearound. Segmented clamp 38 is attached to drill string 12. Load isolator 40 is located between segmented clamp 38 and drill string 12.

Figure 3:
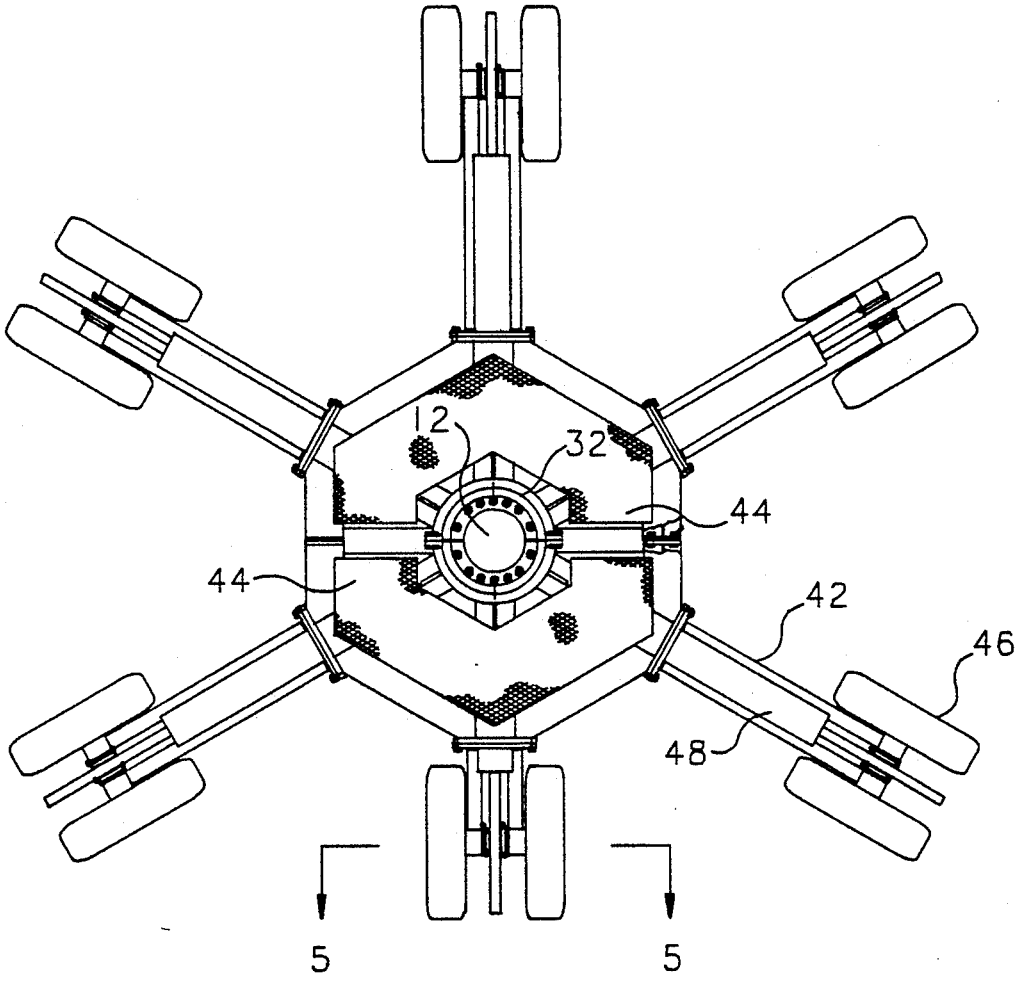
FIG. 3 is a cross-sectional view showing the upper stabilizer of the down boring apparatus of FIG. 1 taken along lines 3—3.
Figure 4:
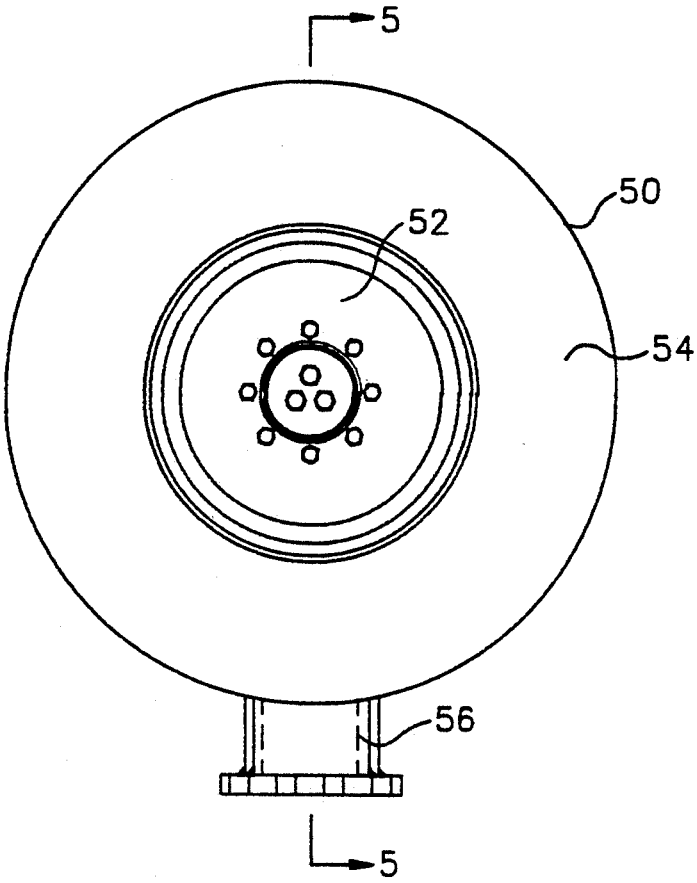
FIG. 4 is an enlarged view of the wheel assembly of the upper stabilizer of the down boring apparatus typifying the invention.
Figure 5:
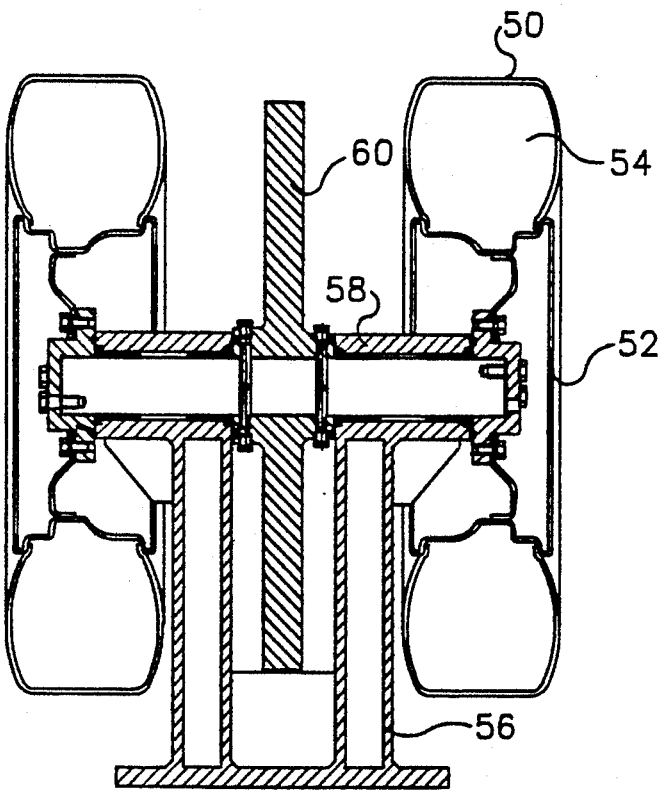
FIG. 5 is an enlarged cross-sectional view of the wheel assembly of the upper stabilizer of the down boring apparatus of FIG. 3 taken along lines 5—5.

Referring now to FIGS. 3 through 5, the upper stabilizer 14 is described in detail. Upper stabilizer 14 is comprised of a plurality, preferably six, stabilizer legs 42 radially secured to upper stailizer hub 32. Disposed over stabilizer legs 42 are support plates 44. Stabilizer legs 42 include wheel assembly 46 and, optionally, leg extensions 48 bracketed between wheel assemblies 46 and upper stabilizer hub 32. Leg extensions can be of numerous predetermined lengths in order to allow down boring of tunnels of various diameters.

Referring to FIGS. 4 and 5, wheel assemblies 46 are comprised of a pair of wheels 50, each of which includes a hub 52 and a tire 54 which is preferably filled with an elastomeric material such as polyurethane. Alternatively, wheel 50 may be a dulled roller cutter known in the art which is attached to a compressible bumper described below. Hub 52 is rotatable around strut 56. Axle 58 connects hub 52 to strut 56. Located between the two wheels 50 on axle 58 is overload wheel 60 which, like wheels 50, is rotatable on axle 58 relative to struts 56. Overload wheel 60 is preferably comprised of a metal alloy or other nondeformable material. Overload wheel 60 provides additional support for down reamer 10 during boring operations where excessive side forces are encountered which overcompress tires 54 of wheel assemblies 46, due to, for example, narrowing of the bored hole diameter. Thus, it is readily apparent that overload wheel 60 has a radius which is less than that of wheels 50 and the difference between these two radii is selected based upon the amount of compression of wheels 50 that is desired during boring operations. Rotation of wheels 50 and overload wheels 60 allow vertical movement of down reamer 10 during stabilization.

Figure 6:
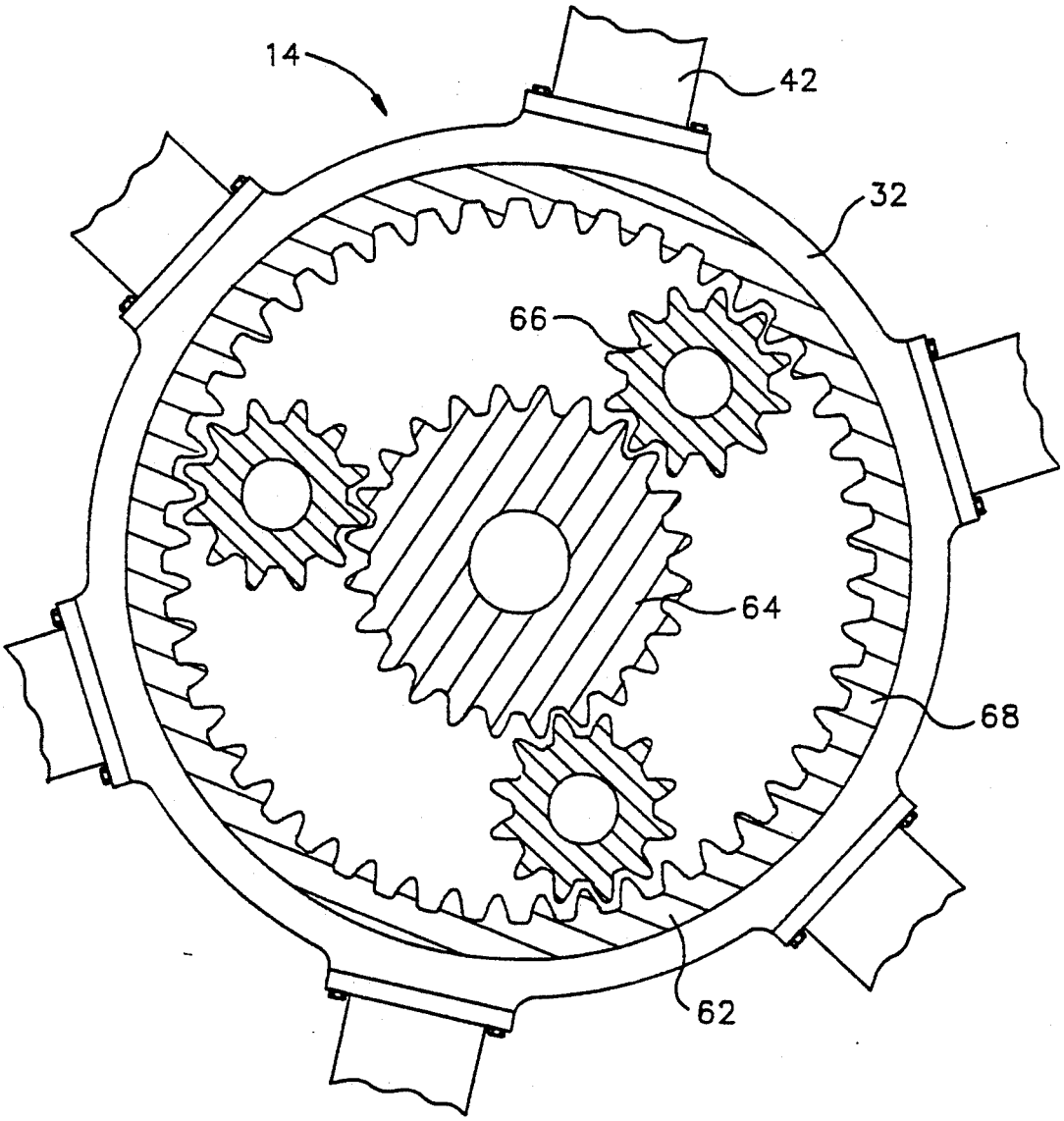
FIG. 6 is a partially exposed top view of the upper stabiizer of the down boring apparatus typifying the present invention having a torque multiplier assembly.
Figure 7:
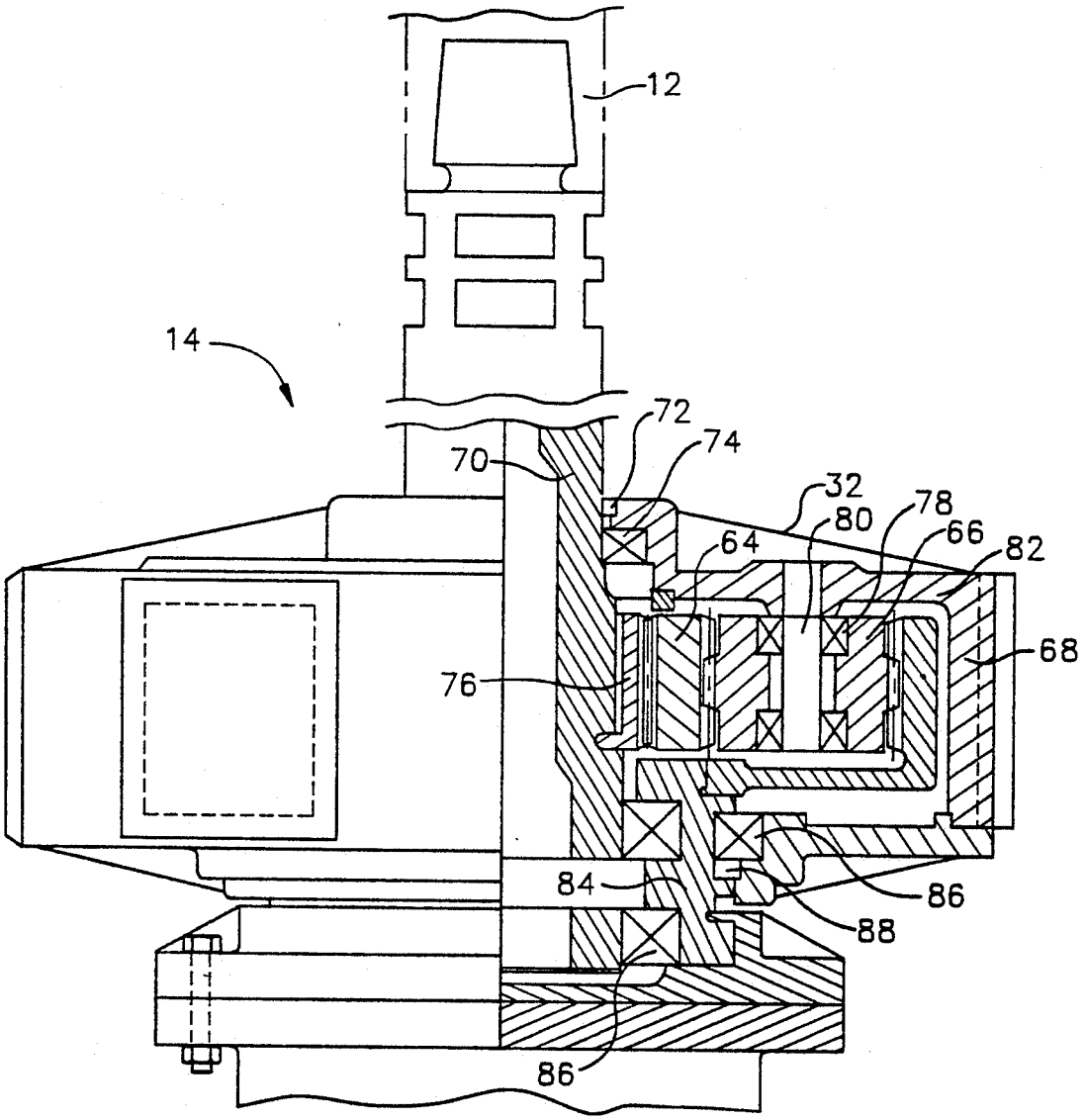
FIG. 7 is a side elevational view, partially in section, of a first embodiment of the upper stabilizer of the down boring, apparatus of the present invention having a torque multiplier assembly with the planet carrier fixed.
Figure 8:
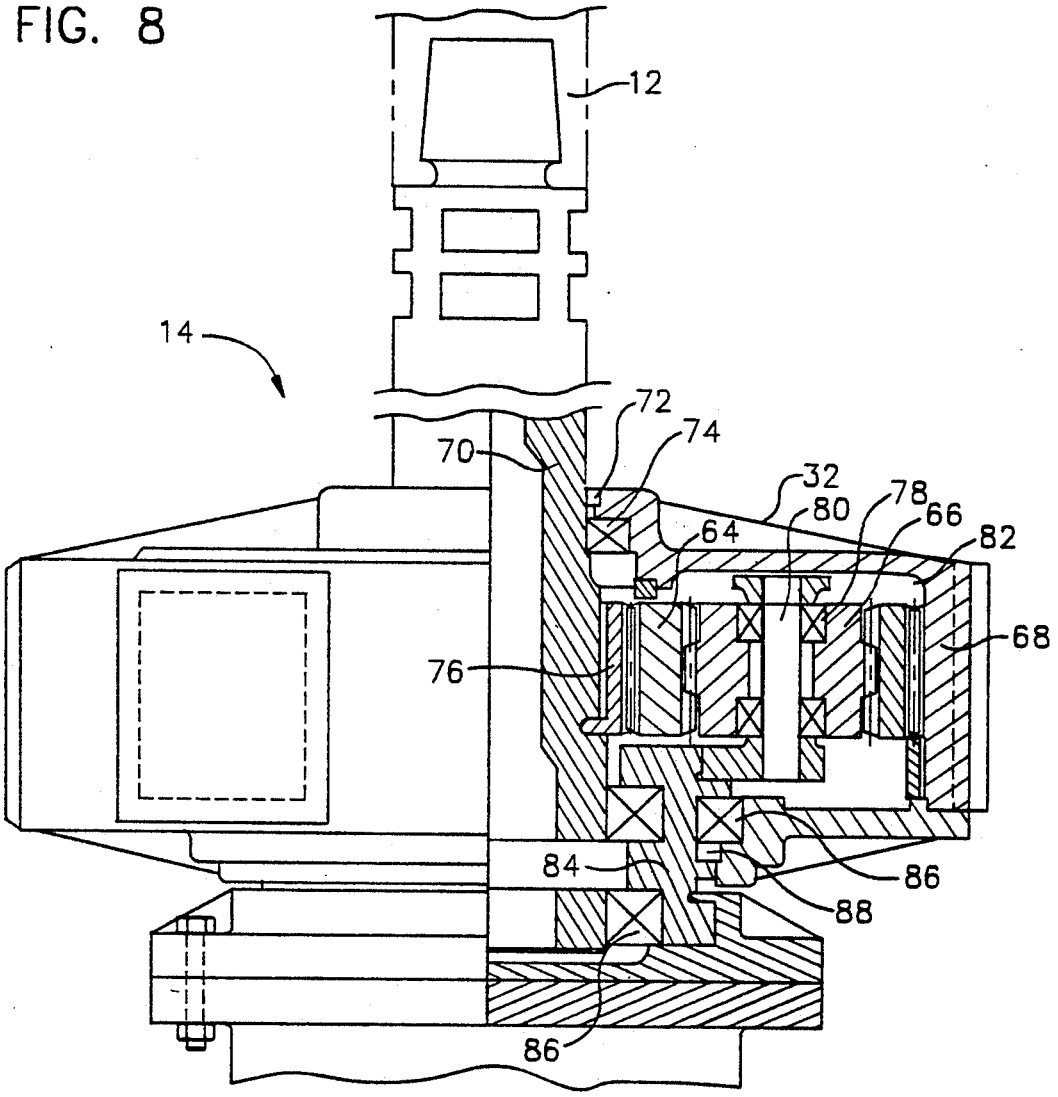
FIG. 8 is a side elevational view, partially in section, of a second embodiment of the upper stabilizer of a down boring apparatus typifying the present invention having a torque multiplier assembly with the ring gear fixed.

Referring now to FIGS. 6 through 8, two optional torque multiplying gearing assemblies 62 for upper stabilizer 14 are disclosed. These two torque multiplier gearing assemblies 62 are configured to be located within upper stabilizer hub 32. The torque multiplier assembly 62 increases the torque from drill string 12 to cutterhead 28, and reduces the rate of rotation of cutterhead 28 as compared to that of drill string 12. Torque multiplication is desired because, to bore relatively larger diameter holes efficiently, it is necessary to employ greater torque than drill string 12 can transmit without breaking.

Referring specifically to FIG. 6, torque multiplier assembly 62 includes planetary gearing comprising a sun gear 64 axially oriented in upper stabilizer hub 32. Planet gears 66 mesh with sun gears 64. Preferably three planet gears 66 are employed but more or less can also be used in order to obtain a desired amount of torque multiplication. Planet gears 66 mesh with ring gear 68 located adjacent the external periphery of upper stabilizer hub 32. Referring to FIG. 7 a first embodiment of torque multiplier assembly 62 is shown in which approximately a 2:1 ratio for example, of torque multiplication is achieved by employing a fixed planet carrier and output from the ring gear. Specifically, input shaft 70 is attached to drill string 12 and has input shaft seal 72 and input shaft bearings 74 located adjacent thereto. Sun gear 64 meshes with input shaft 70 by means of spline 76. As stated above, sun gear 64 also meshes with planet gears 66, which in turn mesh with ring gear 68. Planet gears 66 rotate on planet gear bearings 78 around planet gear shaft 80. Planet gears 66 are supported by planet carrier 82. As previously stated, planet carrier 82 is fixed in this embodiment. Planet gears 66 in turn mesh with ring gear 68, the output of which is transmitted to output shaft 84. Output shaft 84 is located adjacent the lower portion of upper stabilizer hub 32 and is rotatable by means of output shaft bearings 86. Output shaft seals 88 are located adjacent output shaft 84. In operation, rotation of drill string 12 causes rotation of input shaft 70, spline 76, sun gear 64, planet gear 66, ring gear 68 and output shaft 84.

Referring now to FIG. 8, a second embodiment of torque multiplier assembly 62 is disclosed in which a greater than 2:1 ratio of torque multiplication is obtained. The second embodiment of the torque multiplier assembly 62 of FIG. 8 is substantially identical to the first embodiment of the torque multiplier assembly 62 of FIG. 7 with the exception that in the second embodiment of the torque multiplier assembly 62 ring gear 68 is fixed and output is from planet carrier 82. Thus, in operation of the second embodiment of the torque multiplier assembly 62 of the present invention, rotation of drill string 12 causes corresponding rotation of input shaft 70, sun gear 64, planet gear 66, planet carrier 82, and output shaft 84.

In the above two embodiments of torque multiplier assembly 82, either the ring gear 68 or planet carrier 82 is fixed by the torque reaction applied by the frictional forces of the wheel assemblies 46 and stabilizer legs 42. If the frictional forces are deemed inadequate to react the torque from torque multiplier assembly 62, the above-mentioned dulled roller cutter can be employed as wheel 50 to cut into the rock to increase the torque reaction capabiities.

Figure 9:
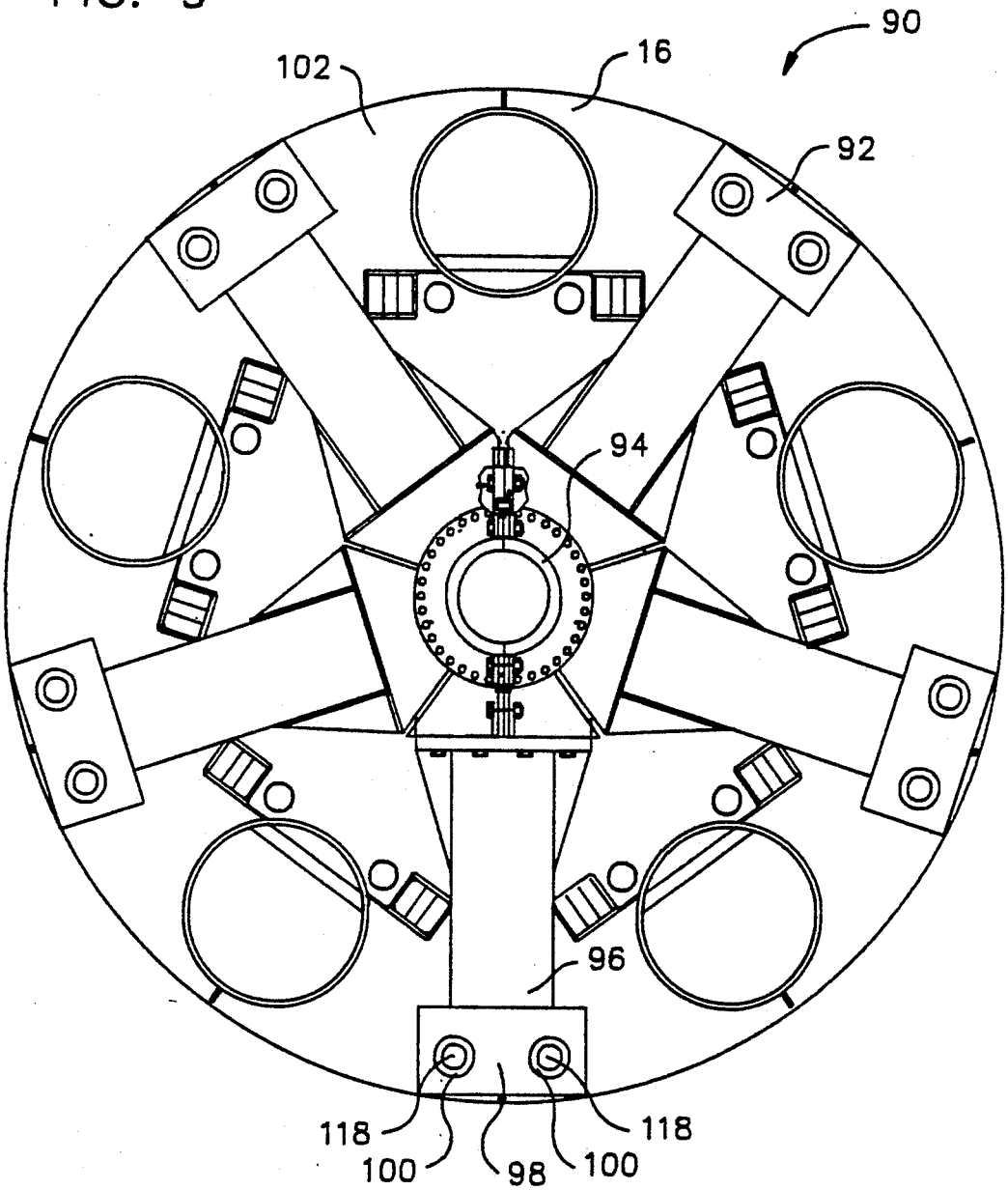
FIG. 9 is a cross-sectional view of the weight clamp and of the down boring apparatus of FIG. 1 taken along lines 9—9.
Figure 10:
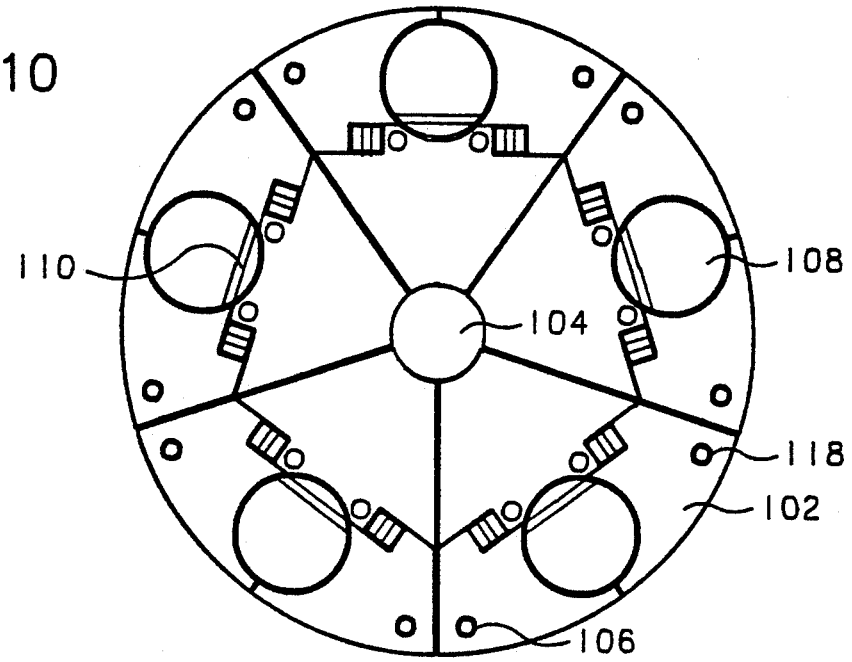
FIG. 10 is a cross-sectional view of the weight plates of the down boring apparatus of FIG. 1 taken along lines 10—10.
Figure 11:
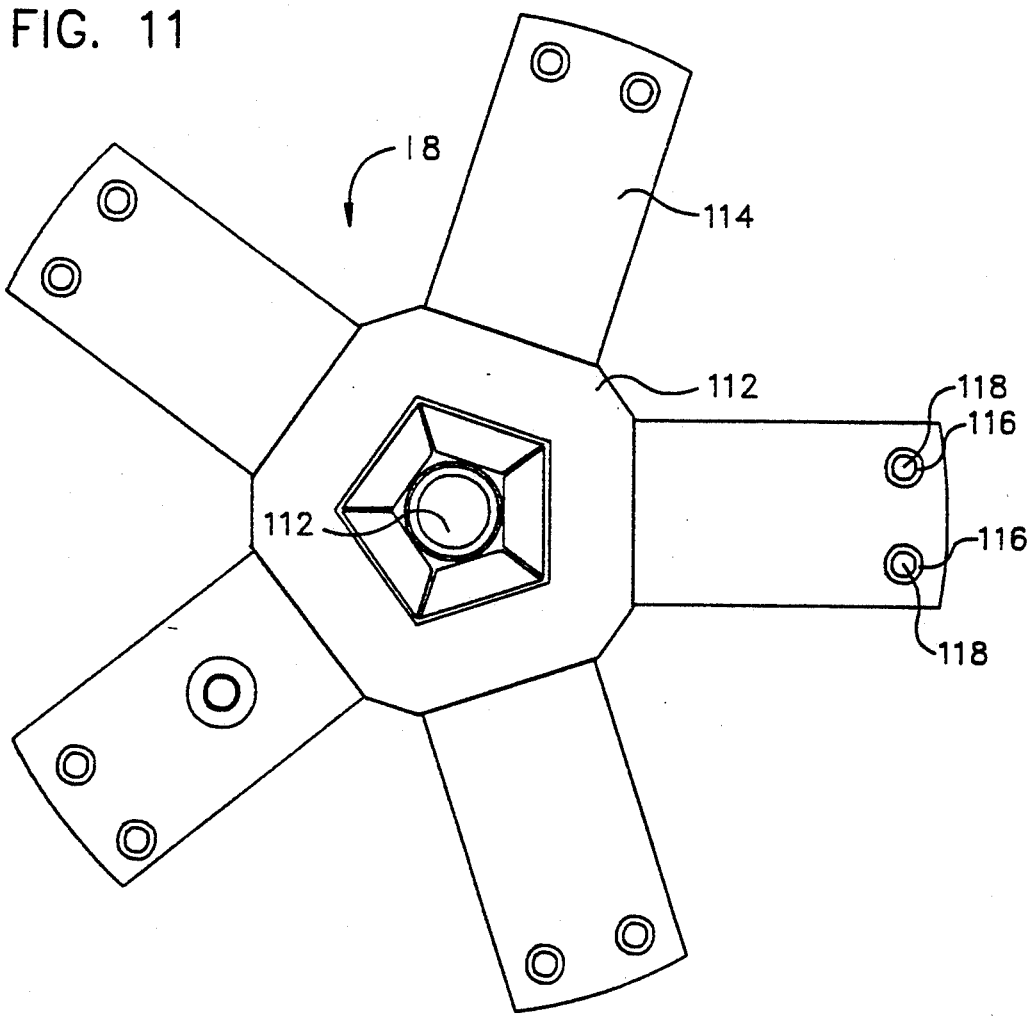
FIG. 11 is a cross-sectional view of the spider, or lower weight plate support, of the down boring apparatus of FIG. 1 taken along lines 11—11.

Referring now to FIGS. 9 through 11, weight assembly 90 of down reamer 10 is described in detail. Weight assembly 90 includes top weight clamp 92, positioned above a plurality of weight plates 16 and spider 18 oriented below weight plates 16. Spider 18 is also termable as a lower weight clamp. Referring to FIG. 9, upper weight clamp 92 includes weight clamp hub 94 oriented around drill string 12. A plurality of weight clamp arms 96 are radially disposed around weight clamp hub 94. Each of weight clamp arms 96 has a tie rod platform 98 on its end remote from weight clamp hub 94. Each tie rod platform 98 has one or more tie rod openings 100 therein.

Referring now to FIGS. 9 and 10, weight plates 16 of weight assembly 90 are described in detail. Each of weight plates 16 is comprised of a high mass material such as lead or a high mass metal alloy. Each weight plate 16 is preferaly comprised of a plurality of wedge shaped sections 102, which may be, for example, five in number. Wedge shaped sections 102 are radially disposed around opening 104 through which drill string 12 passes. Each of wedge shaped sections 102 has tie rod openings 106 therein which are adapted to be aligned with tie rod openings 100 of upper weight clamp 92. Additionally, one or more of wedge shaped sections 102 has a manway hole 108 therethrough. Manway hole 108 has rung 110 therein. Tie rod openings 106 and manway hole 108 are oriented in wedge shaped sections 102 of successive layers of stacked weight plates 16 such that tie rods can pass through the tie rod openings 102 in weight plates 16, and a manway is formed by the manway holes 108 of the stacked weight plates 16 such that an individual can pass therethrough to access cutterhead 28 for modification and/or maintenance thereof. Adjacent layers of weight plates 16 are preferably configured such that the wedge shaped sections 102 of each of the adjacent weight plates 16 are offset to maximize structure integrity of weigh assembly 90.

Now referring to FIG. 11, the spider 18, or lower weight clamp, of weight assembly 90 of down reamer 10 is described in detail. Spider 18 includes a spider hub 112 having a center portion in which stinger 20 of drill string 12 is securedly attached. A plurality of spider arms 114, preferably five in number, are radially disposed on spider hub 112. Each spider arm 114 has tie rod openings 116 passing therethrough. Tie rod openings 116 are oriented on each of spider arms 114 such that tie rod openings 116 are aligned with tie rod openings 106 of weight plates 116 and tie rod openings 100 of upper weight clamp 92 such that tie rods 118 pass through tie rod openings 100, 106, and 116. As shown in FIG. 1, tie rods 118 are secured through upper weight clamp 92, weight plates 16, and spider 18 of weight assembly 90 by jack 120. Thus, tie rods 118 secure weight plates 16 with upper weight clamp 92 and spider 18 of weight assembly 90 such that loads from rotation of cutterhead 28 are transmitted into weight assembly 90 as opposed to into stinger 20 of drill string 12. More specifically, rotation of drill string 12 results in rotation of upper weight clamp 92, weight plate 16 and spider 18 of weight assembly 90, as well as rotation of torque tube 24 and spider support arms 26 located between spider 18 and cutterhead 28, and also rotation of cutterhead 28. Thus, over-turning loads encountered by cutterhead 28 during boring pass from cutterhead 28 through torque tube 24 and spider support arms 26, and into weight assembly 90 and upper stabilizer 14 where the relatively larger diameter of weight plates 16, as compared to that of drill string 12, results in a greater section modulus which allows weight assembly 90 to withstand greater over-turning loads than drill string 12.

Figure 12:
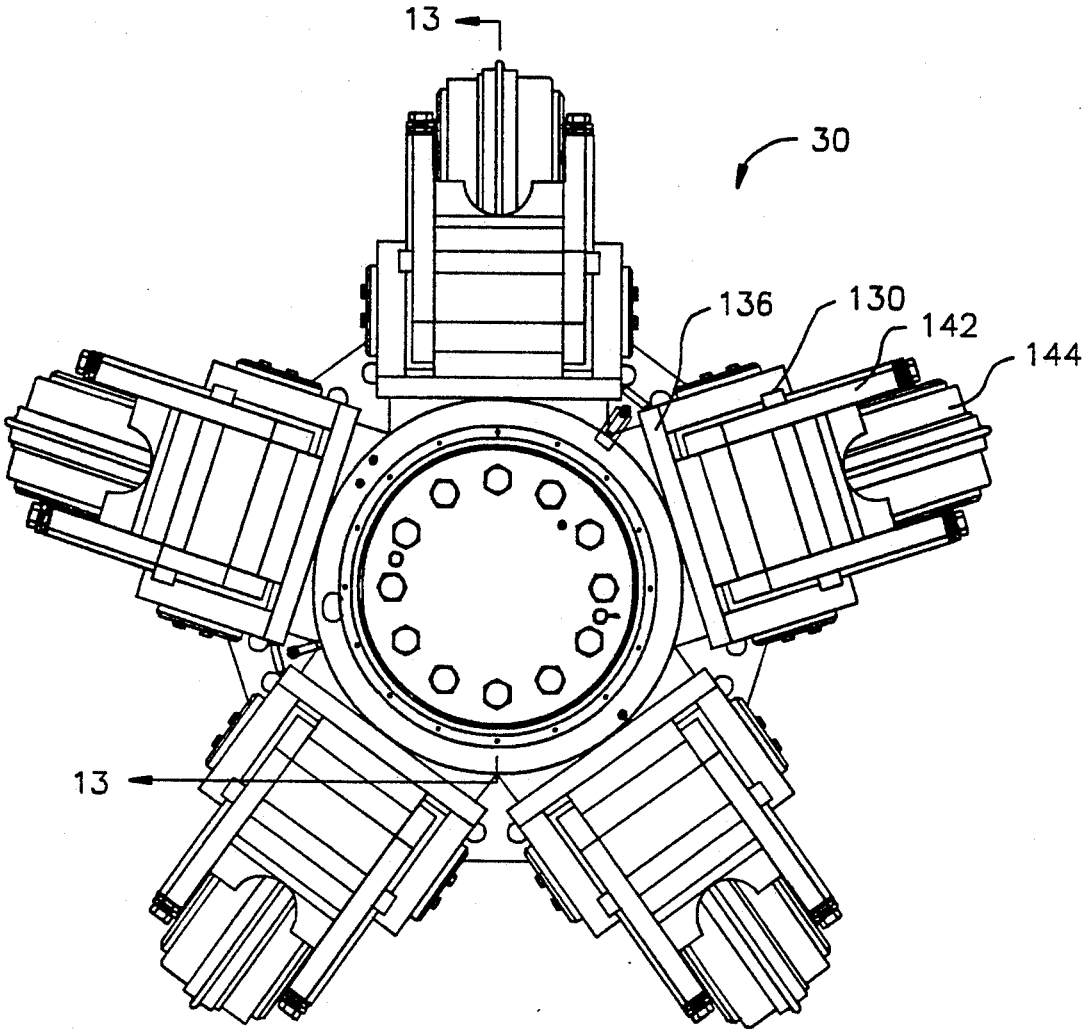
FIG. 12 is an end view of the lower stabilizer of the down boring apparatus typifying the present invention.
Figure 13:
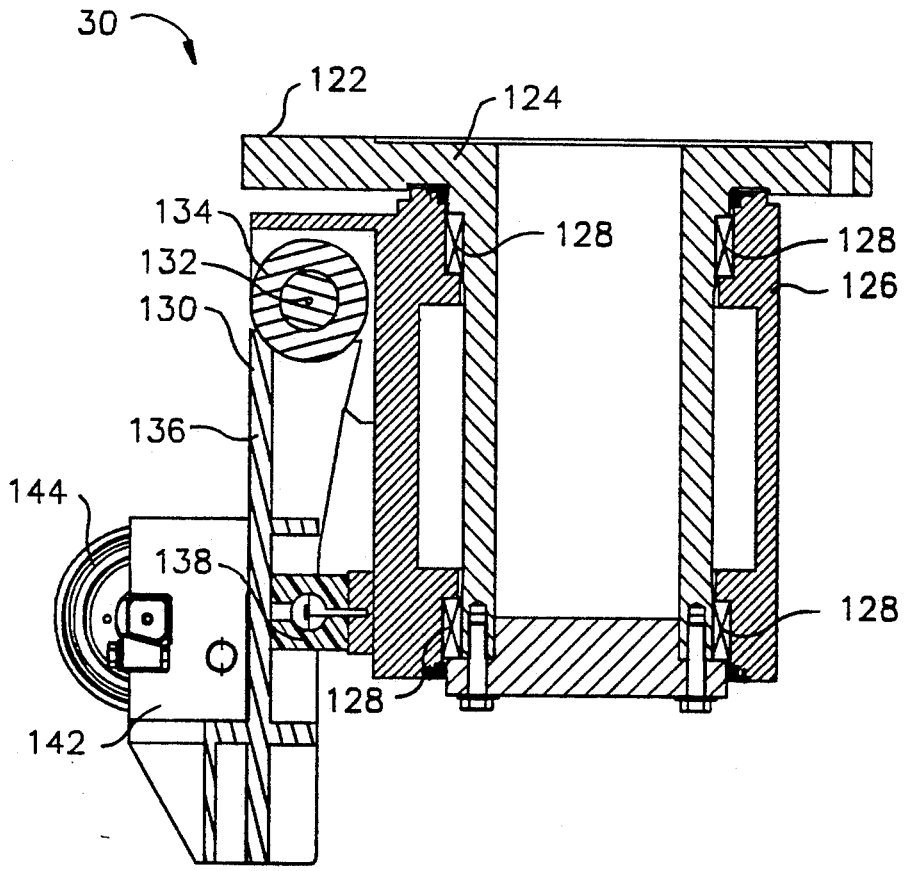
FIG. 13 is an enlarged view, partially in section, of the wheel assembly of the lower stabilizer of the down boring apparatus typifying the present invention.
Figure 14:
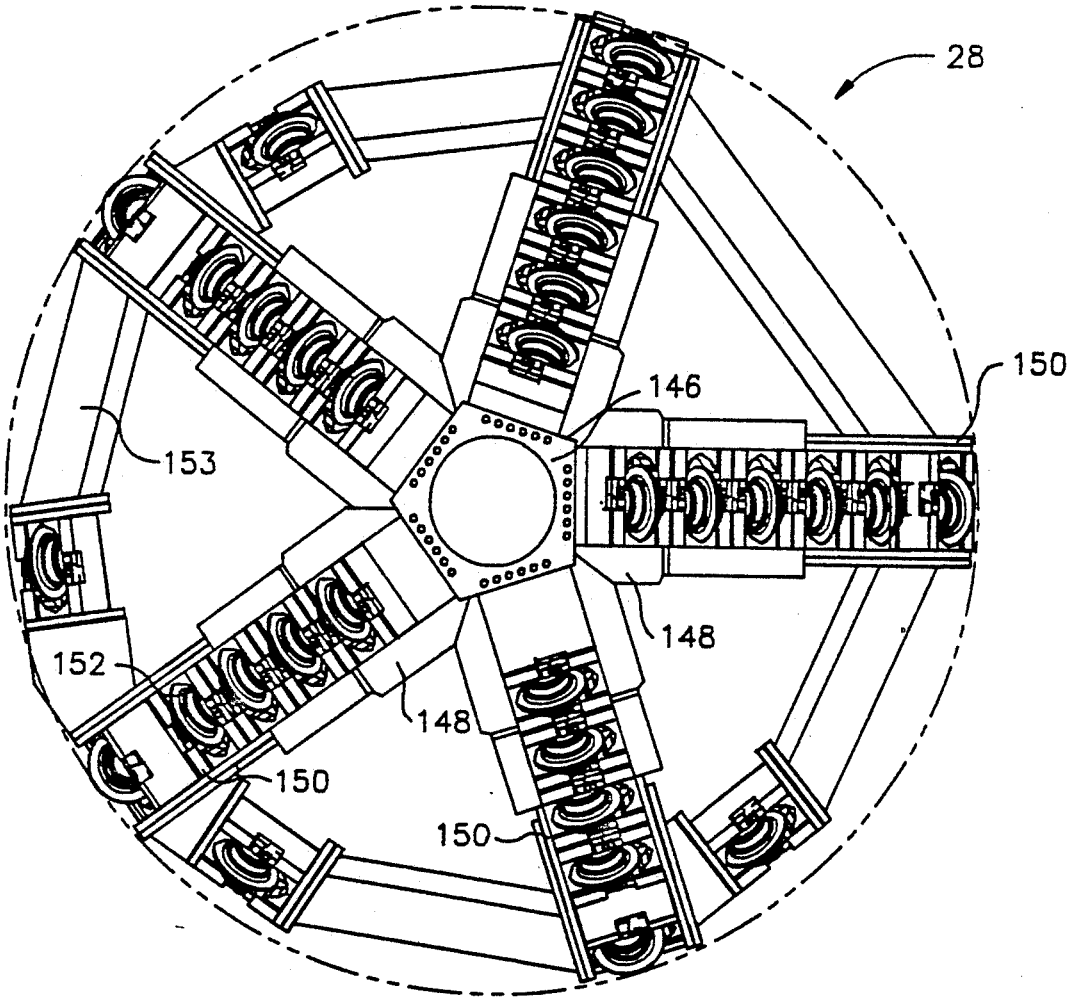
FIG. 14 is a cross-sectional view of the cutterhead of the down boring apparatus of FIG. 1 taken at lines 14—14 and showing a first cutterhead diameter.
Figure 15:
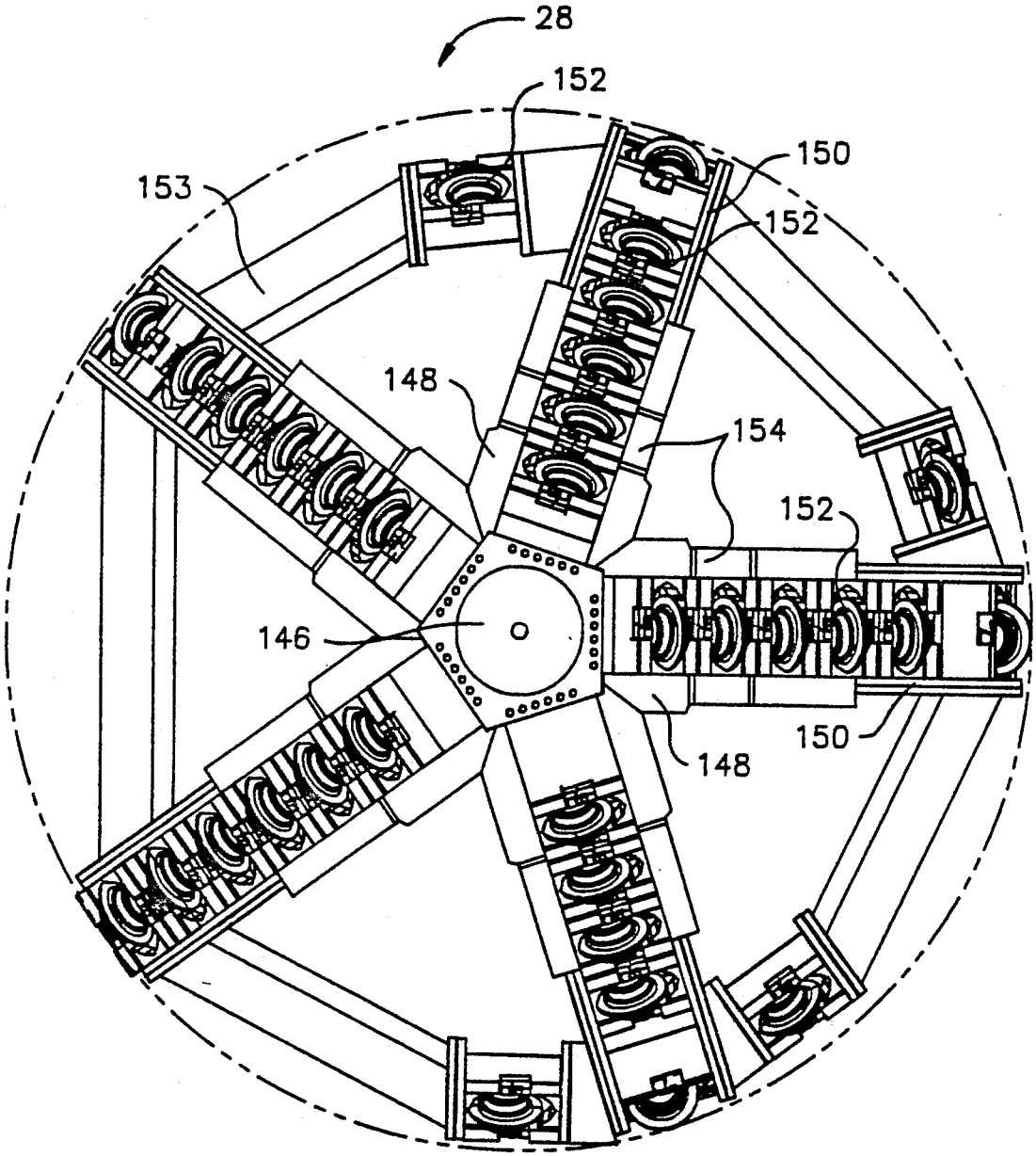
FIG. 15 is a cross-sectional view of the cutterhead of the down boring apparatus of FIG. 1 taken at the same location as FIG. 14 and showing a second cutterhead diameter.

Referring now to FIGS. 12 and 13, the lower stabilizer 30 of the down reamer 10 is described in detail. Lower stabilizer 30 includes a lower stabilizer hub 122 comprised of an inner race 124 fixedly secured to rotatable cutterhead 28 and an outer race 126 rotatably attached to inner race 124 by bearings 128. A plurality of wheel assemblies 130 are radially secured to outer race 126. Preferably five wheel assemblies 130 are present. Attachment of wheel assemblies 130 to outer race 126 is by means of pin 132, which is fixedly secured to outer race 126, and pivot sleeve 134 located over pin 132 which is rotatable therearound. Wheel arm 136 is attached to pivot sleeve 134 and is also supported on outer race 126 by a compressible bumper 138. Wheel arm 136 holds wheel mount 142 in which is located rotatable wheel 144.

In operation, as cutterhead 128 rotates, inner race 124 of lower stabilizer 30 rotates as well. However, outer race 126, and wheel assemblies 130 do not rotate with cutterhead 28. Rotatable wheels 144 contact the tunnel wall to provide stabilization for down reamer 10. As compressive forces are encountered by lower stabilizer 30 due, for example, to narrowing of the bored hole diameter, wheel arm 136 pivots on pivot sleeve 134 around pin 132 to stabilize down reamer 10. The length of the pivot stroke of wheel arm 136 is dictated by the degree of compressibility of bumper 138. Rotatable wheels 144 allow vertical movement of down reamer 10 while stabilization is provided by lower stabilizer 30. Rotatable wheels 144 can be, for example, dulled roller cutters known in the art, or, alternatively compressible tires with or without the above described overload wheels.

Referring to FIGS. 14 through 17, cutterhead 28 of down reamer 10 is described in detail. Cutterhead 28 includes a cutterhead body 146 and the plurality of arms 148 radially disposed around cutterhead body 146. Each of arms 148 has attached thereto an arm extender 150. Each arm 148 and arm extender 150 have one or more cutter assemblies 152 secured thereon. Cutter assemblies 152 can include disc cutters or gauge cutters generally known in the art. Cutterhead assemblies 152 are preferably removable from the upper portion of the cutterhead 28 by means of manway holes 108 of weight assembly 90, or adjacent the exterior of down reamer 10. Spacer 154 is adapted to be attached between arm 148 and arm extender 150 to increase the diameter of the cutterhead, as further detailed below. Braces 153 attached adjacent arm extenders 150 and secured thereto are additional cutter assemblies 152 which "float". By "float" it is meant that cutter assemblies 152 can be configured at various locations on any of braces 153. The locations of floating cutter assemblies 152 are varied to load balance the cutterhead when the cutter diameter is increased. More specifically, the forces and moments of each cutter assembly 152, either floating or not, are summed to balance the cutterhead 28. The factors considered in ascertaining the forces and moments of each cutter assembly 152 include the hardness and fracture toughness of the rock being bored.

Figure 16:
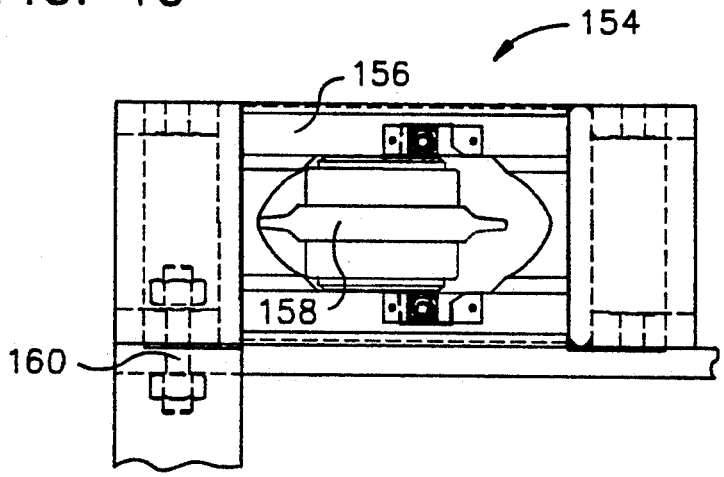
FIG. 16 is an enlarged top view of the spacer of the cutterhead of the down boring apparatus typifying the present invention.
Figure 17:
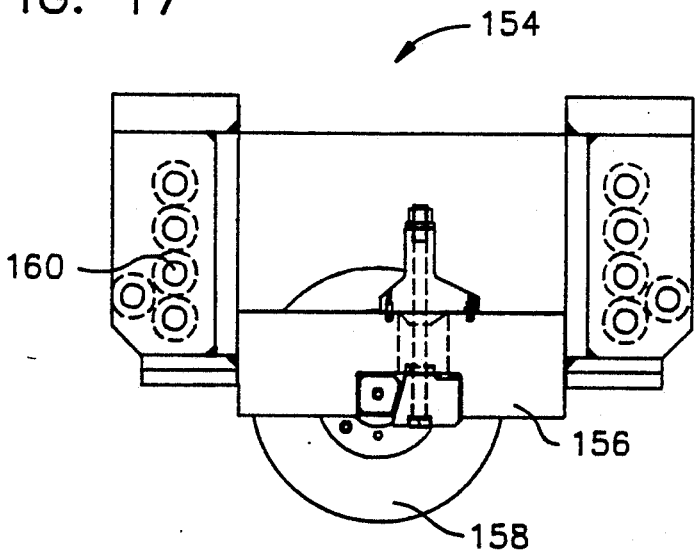
FIG. 17 is an enlarged side view of the spacer of the cutterhead of the down boring apparatus typifying the present invention.

As shown in FIGS. 16 and 17, spacer 154 includes cutter assembly 156 preferably having a disc cutter 158 known in the art. Spacer 154 is fixedly secured between arm 148 and ar extender 150 by means of bolts 160 or the like.

Figure 18:
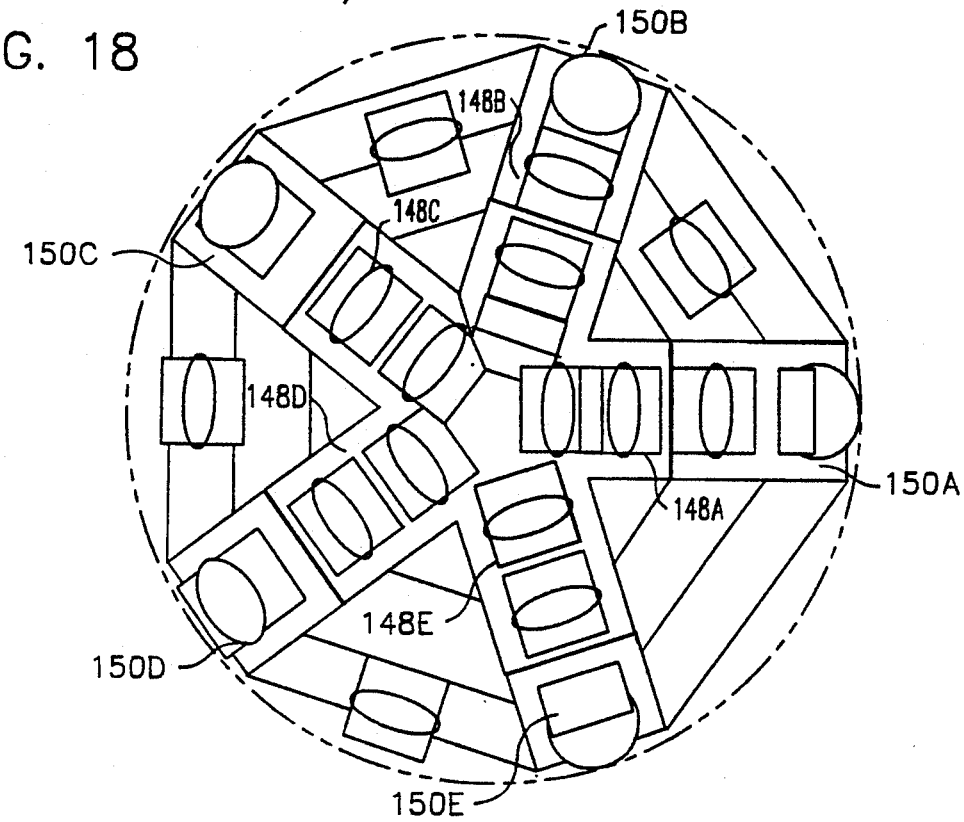
FIG. 18 is a schematic view of the cutterhead of the down boring apparatus typifying the present invention having a first diameter.
Figure 19:
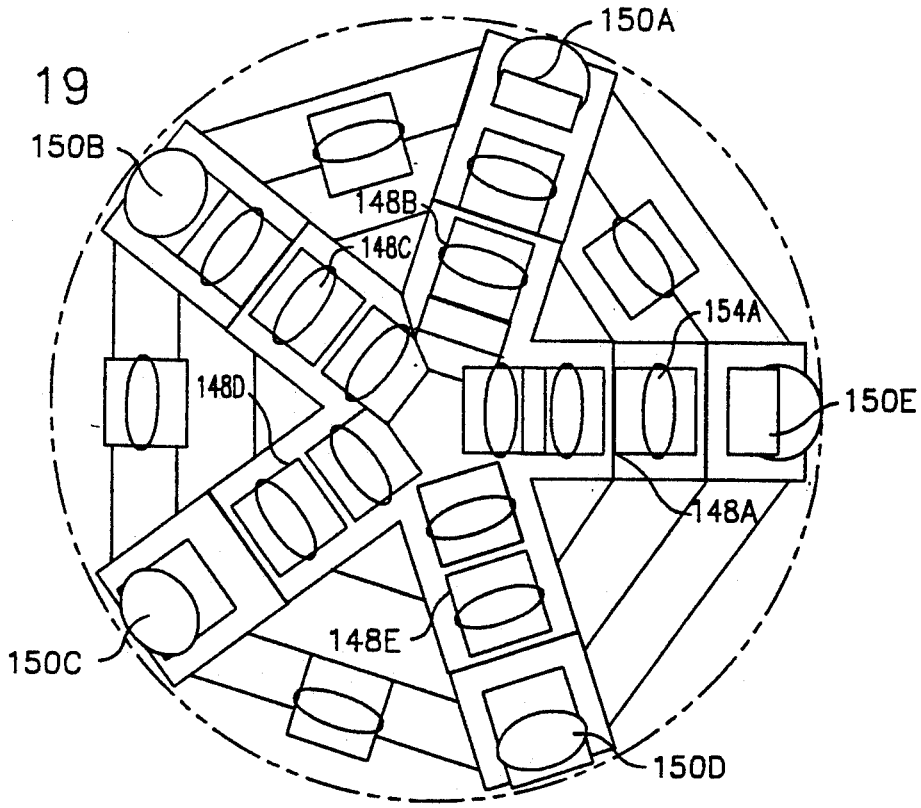
FIG. 19 is a schematic view of the cutterhead of the down boring apparatus typifying the present invention reconfigured in a second larger diameter by the addition of a single spacer.

Referring now to FIGS. 18 and 19, the use of spacers 154 to increase the diameter of cutterhead 28 is further described. Referring specifically to FIG. 18, cutterhead 28 having a first, initial diameter is comprised of a plurality of arms 148. As shown in FIG. 18, five arms 148 are designated therein as 148A, 148B, 148C, 148D, and 148E. However it is to be understood that more or less than five arms 148 may be employed. Each of arms 148A through 148E has a different length, and the length difference between any two adjoining arms 148A through 148E is equal. More specifically, arm 148A has the shortest length of all of arms 148A through 148E. Arm 148E has the greatest length of all arms 148A through 148E. Additionally, the length of arms 148E through 148A preferably decreases in a radial direction around cutterhead 28 such that, as shown in FIG. 18, arm 148D is shorter than arm 148E, arm 148C is shorter than arm 148D, arm 148B is shorter than arm 148C, and, finally, arm 148A is shorter than arm 148B. As stated above, the length difference between any two adjoining arms is the same. An arm extender 150 is attached to each of arms 148A through 148E. Each arm extender is designated as 150A, 150B, 150C, 150D, and 150E based on which of respective arms 148A through 148E the arm extender is attached. Thus, for example, arm extender 150A is attached to arm 148A in FIG. 18. Each of arm extenders 150A through 150E has a length such that the combined length of each of arms 148A through 148E and its attached arm extender 150A through 150E are substantially equal.

Now referring to FIG. 19, the diameter of cutterhead 28 has there been increased from the diameter shown in FIG. 18. Increasing the diameter of the cutterhead 28 is accomplished by the attachment of spacer 154A to arm 148A as shown in FIG. 19. Preferably spacer 154A is attached to the shortest of arms 148A through 148E of cutterhead 28. Next, arm extenders 150A through 150E are reconfigured on arms 148A through 148E by removing each arm extender 150A through 150E from the arm 148A through 148E to which it is attached and reattaching each arm extender 150A through 150E to an arm 148A through 148E adjacent to the arm 148A through 148E to which that particular arm extender 150A through 150E was previously attached. Thus, as shown in FIG. 19, each of arm extenders 150A through 150E has been rotated one position in the counterclockwise direction so that arm extender 150A is now attached to arm 148B, arm extender 150B is attached to arm 148C, arm extender 150C is attached to arm 148D, arm extender 150D is attached to arm 148E and arm extender 150E is attached to spacer 154A which is secured to arm 148A. Thus, the repositioning of arm extenders 150A through 150E on arms 148A through 148E, and the addition of spacer 154A, results in a new, greater length that is substantially equal for each arm and attached, repositioned arm extender. By "substantially equal length" it is meant that upon addition of spacer 154A, arms 148A through 148E and attached arm extenders 150A through 150E have lengths which maintain the desired cutterhead profile (i.e. the relative relationship of the various cutter assemblies 152 on cutterhead 28). Preferably, in order to achieve the desired increase in diameter of cutterhead 28, the above-mentioned difference in length between any two adjacent arms 148A through 148E, multiplied by the number of arms 148A through 148E will be substantially equal to the length of the spacer 154 added to cutterhead 28. In other words, if five arms 148A through 148E are present, the difference in length between any two adjacent arms 148A through 148E will equal one-fifth of the length of spacer 154. Thus, the increase in diameter of cutterhead 28 is equal to the length of spacer 154 divided by the number of arms 148A through 148E. If five arms 148A through 148E are present, the increase in diameter of cutterhead 28 will therefore be equal to one-fifth of the length of spacer 154.

Figure 20:
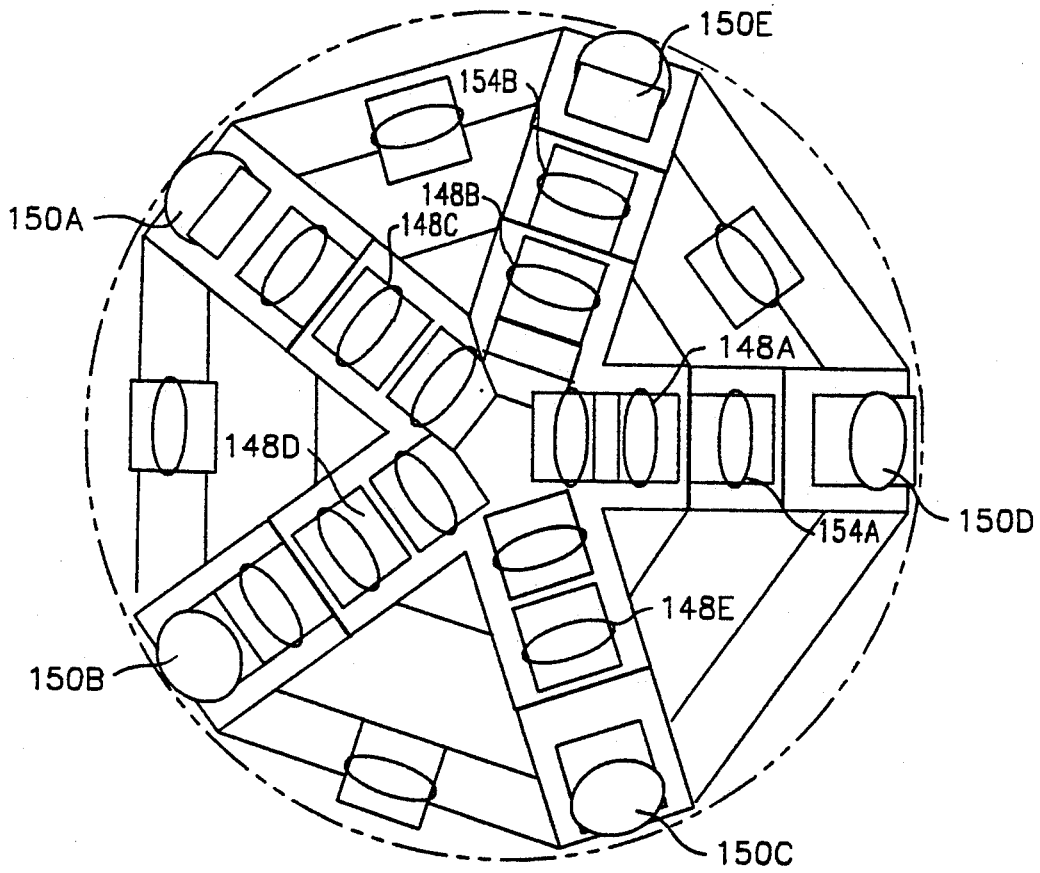
FIG. 20 is a schematic view of the cutterhead of the down boring apparatus typifying the present invention reconfigured in a third larger diameter by the addition of two spacers.

FIG. 20 shows an increase in the diameter of cutterhead 28 over the diameter shown in FIG. 19 by the addition of yet another spacer 154. In FIG. 20, spacer 154B has been attached to arm 148B and all of arm extenders 150A through 150E have been rotated an additional position in the counterclockwise direction so that arm extender 150A is now attached to arm 148C, arm extender 150B is attached to arm 148D, arm extender 150C is attached to arm 148E, arm extender 150D is attached to spacer 154A which is secured to arm 148A, and arm extender 150E is attached to newly added spacer 154B which is secured to arm 148B. Note that newly added spacer 154B has been added to the next shortest arm, namely 148B. It is readily apparent that the diameter of cutterhead 28 can be repeatedly, incrementally increased by the further addition of spacers 154 so that a cutterhead 28 having a diameter as shown in FIG. 21 can be obtained.

Figure 21:
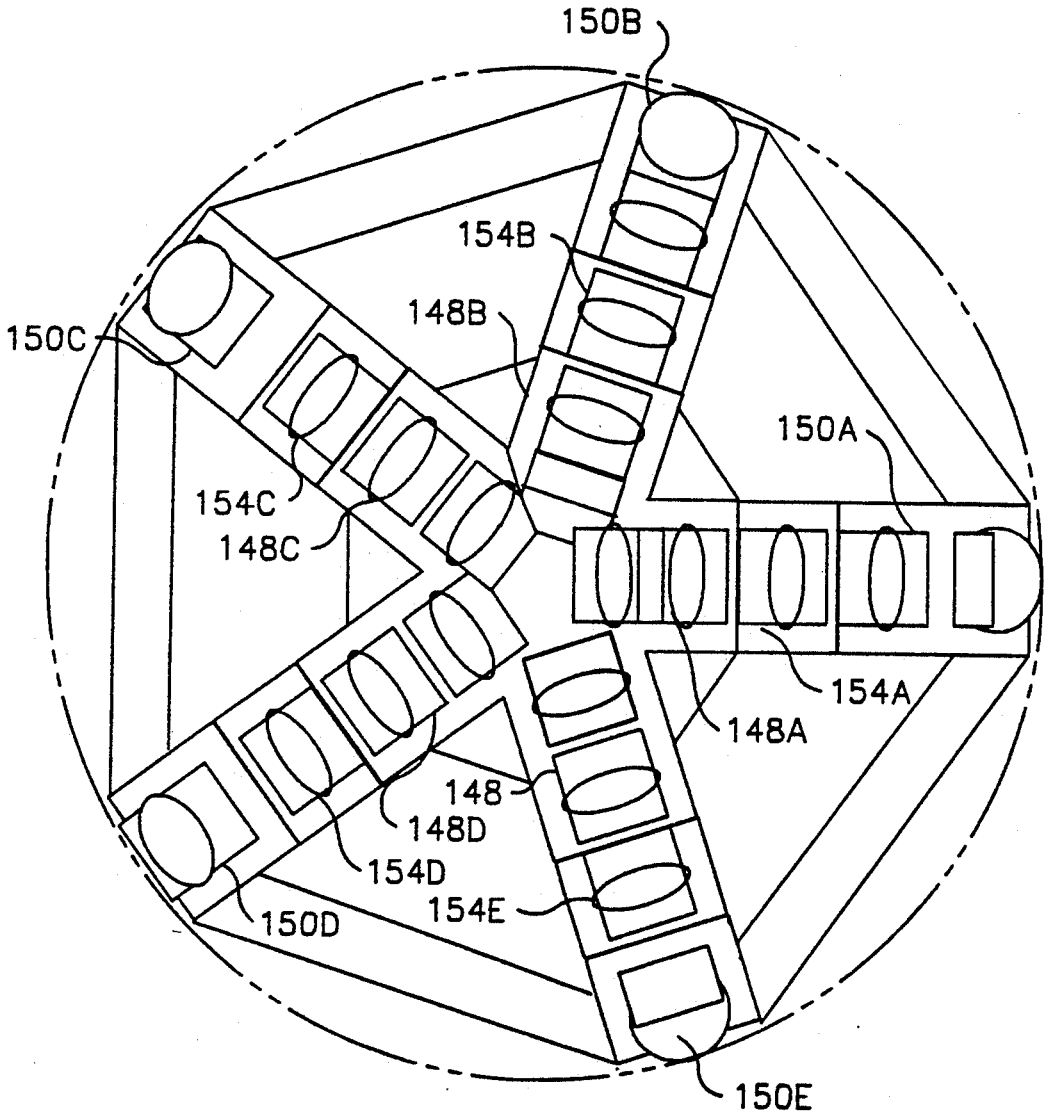
FIG. 21 is a schematic view of the cutterhead of the down boring apparatus typifying the present invention reconfigured in a fourth larger diameter by the addition of five spacers.

In FIG. 21, five spacers, 154A through 154E have been added to the five arms 148A through 148E, respectively. During each incremental spacer addition, arm extenders 150A through 150E were rotated one position in the counterclockwise direction and attached to the adjacent arm 148A through 148E.

Figure 22:
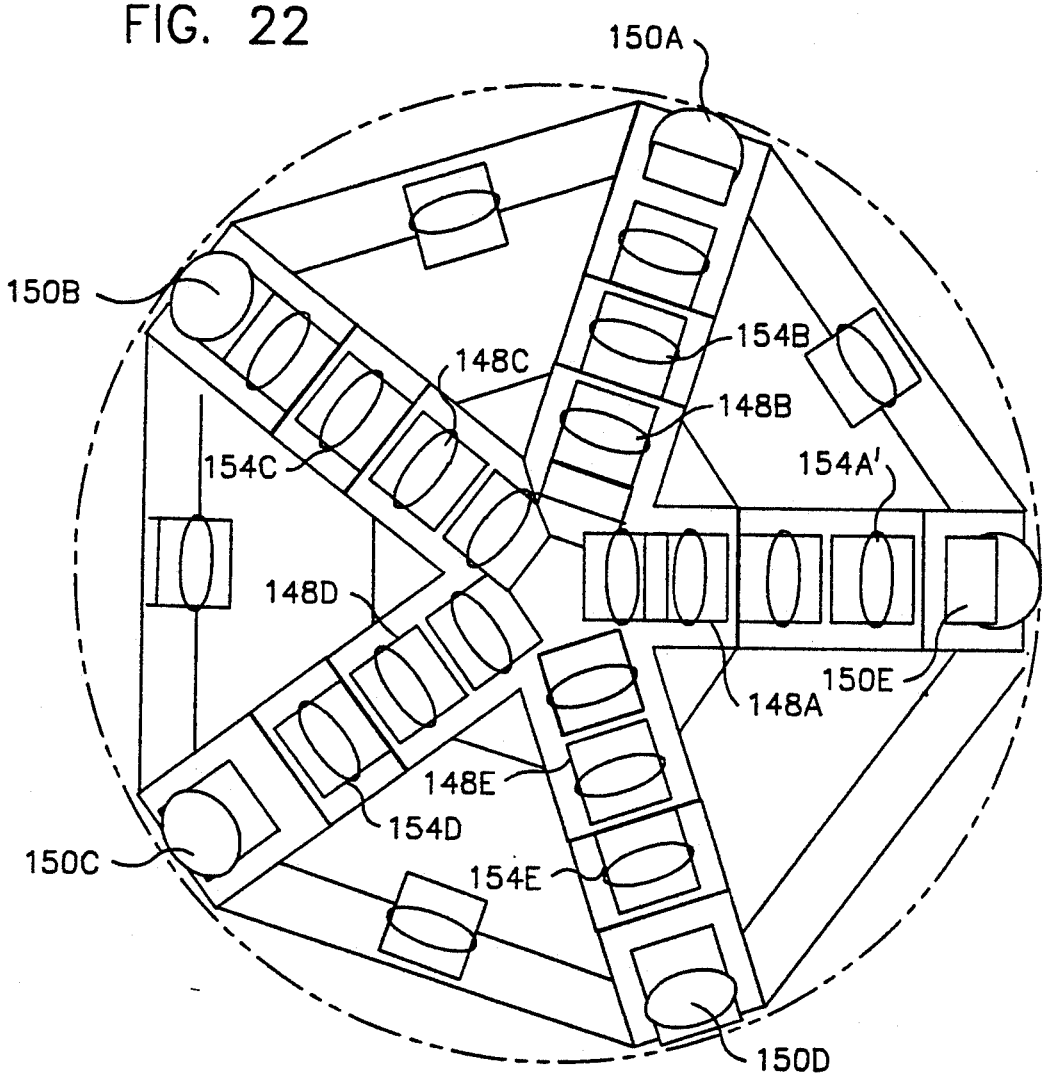
FIG. 22 is a schematic view of the cutterhead of the down boring apparatus typifying the present invention reconfigured in a fifth larger diameter by the addition of four single spacers and the substitution of a double spacer for the fifth single spacer.

FIG. 22 shows a cutterhead 28 having a diameter greater than the diameter shown in FIG. 21 in which five spacers 154A through 154E were added. In FIG. 22, spacer 154A has been removed and spacer 154A' has been added. Spacer 154A' has a length greater than that of spacer 154A, and preferably includes an additional cutter assembly thereon. In addition to the substitution of spacer 154A' for spacer 154A on arm 148A, each of arm extenders 150A through 150E were rotated one position in the counterclockwise direction and attached to the adjacent arm 148A through 148E as previously described. It is readily apparent that the diameter of cutterhead 28 can be further increased from the diameter shown in FIG. 22 by the addition of even more spacers 154A' through 154E' having lengths greater than spacers 154A through 154E. Each of spacers 154A' through 154E' would be incrementally substituted for spacers 154A through 154E, respectively. Furthermore, spacers having a length greater than 154A' through 154E', and preferably having more than two cutter assemblies thereon, could subsequently be added to increase the diameter of cutterhead 28 even further.

While the above described use of spacers 154A through 154E and sequential repositioning of arm extenders 150A through 150E on arms 148A through 148E was made with reference to down reamer 10, it is readily apparent that a cutterhead 28 capable of this type of increase in diameter can be employed on any apparatus employing a rotatable cutterhead, such as a down reamer, a raise borer, a tunnel boring machine, a mobile mining machine, and any and all machines employed in mining tunneling and excavation operations.

It is also to be understood that while the arm extenders 150A through 150E have been described as being repositioned in a counterclockwise direction, arm extenders 150A through 150E may also be repositioned in a clockwise direction, or, alternatively, may be repositioned onto respective arm 148A through 148E which are not necessarily adjacent provided that said repositioning results in a length that is substantially equal for each arm and attached, repositioned arm extender.

The above described embodiments are intended to be descriptive, not restrictive. The full scope of the invention is described by the claims, and any and all equivalents are included.

What is claimed is:

1. An apparatus adapted to be attached to a drill string, said down reaming apparatus having a frame and a rotatable cutterhead, said down reaming apparatus comprising:

an upper stabilizer having an upper stabilizer hub adapted to be oriented around the drill string such that the drill string is rotatable relative to said hub, and a plurality of wheel assemblies radially attached to said upper stabilizer hub, each of said wheel assemblies having a compressible wheel means adapted to be oriented against a bored hole wall and a rotatable overload wheel means having a radius less than that of said compressible wheel means such that said overload wheel means is oriented against the bored hole wall upon compression of said compressible wheel means;

a weight assembly having a plurality of plates stacked in a plurality of layers, each of said plates having a plurality of tie rod openings, a plurality of tie rods adapted to be placed through said tie rod openings of said plates, and means for securing said tie rods to secure said plates on the frame of said down reaming apparatus such that loads from rotation of the cutterhead are into said weight assembly; and a lower stabilizer having a lower stabilizer hub having an inner race attached to the cutterhead and an outer race rotatable with respect to said inner race, and a plurality of wheel assemblies radially attached to said lower stabilizer hub, each of said wheel assemblies having a rotatable wheel on a wheel support and a compressable bumper between said wheel support and said lower stabilizer hub, said wheel support being pivotally connected to said lower stabilizer hub whereby reaction of said wheel against a bored hole wall causes pivotal movement of said wheel support against said compressable bumper.

2. The down reaming apparatus of claim 1, wherein said plurality of wheel assemblies of said upper stabilizer are six in number.

3. The down reaming apparatus of claim 1, wherein each of said wheel assemblies of said upper stabilizer are comprised of one overload wheel means between two compressible wheel means.

4. The down reaming apparatus of claim 1, wherein said upper stabilizer further comprises:

removable leg extension means located between said upper stabilizer hub and each of said wheel assemblies.

5. The down reaming apparatus of claim 1 , wherein said upper stabilizer further comprises a torque multiplier assembly in said upper stabilizer hub, said torque multiplier assembly comprising:

rotatable input shaft means attached to the drill string;

sun gear means meshed with said input shaft means;

planet gear means meshed with said sun gear means and supported by planet carrier means;

ring gear means meshed with said planet gear means; and rotatable output shaft means whereby rotation of said input shaft means causes rotation of said output shaft means with torque greater than that of said input shaft means.

6. The down reaming apparatus of claim 5, wherein said ring gear means is rotatable and is meshed with said output shaft means, and said planet carrier means is not rotatable.

7. The down reaming apparatus of claim 5, wherein said planet carrier means is rotatable and is nested with said output shaft, and said ring gear means is not rotatable.

8. The down reaming apparatus of claim 1, wherein each of said plates of said weight assembly includes an opening therethrough, each of said openings being oriented in each of said plates such that said openings are aligned to form a manway upon stacking of said plates.

9. The down reaming apparatus of claim 8, wherein the cutterhead of the rock boring apparatus has a plurality of cutter assemblies and said manway of said weight assembly provides access to the cutterhead to reconfigure the cutter assemblies.

10. The down reaming apparatus of claim 1, wherein each of said plates is comprised of a plurality of wedge-shaped sections.

11. The down reaming apparatus of claim 10, wherein said wedge-shaped sections of each layer of said plates are radially off-set from said wedge-shaped sections of each adjoining layer of said plates.

12. The down reaming apparatus of claim 1, wherein said means for securing said tie rods of said weight assembly comprises:

a top weight clamp having tie rod openings therein, said top weight clamp adapted to be oriented above said plates;

a bottom weight clamp having tie rod openings therein, said bottom weight clamp adapted to be oriented below said plates and to fixedly hold an end of each of said tie rods; and jack means attached to said tie rods such that said tie rods are oriented through said tie rod openings of said plates, said top weight clamp and said bottom weight clamp, and said jack means applies a compressive force against said plates to secure said plates on the frame of the rock boring apparatus.

13. The down reaming apparatus of claim 1, wherein said plurality of wheel assemblies of said lower stabilizer are five in number.

14. The down reaming apparatus of claim 1, wherein said cutterhead has a plurality of cutter assemblies reconfigurable from the upper portion of said cutterhead.

15. A stabilizer for a rock boring apparatus adapted to be attached to a drill string, said stabilizer comprising:

a rotationally stationary stabilizer hub adapted to be oriented around the drill string such that the drill string is rotatable relative to said rotationally stationary stabilizer hub; and a plurality of wheel assemblies radially and fixedly attached to said stabilizer hub, each of said wheel assemblies having a compressible wheel means having an axis of rotation and adapted to be oriented against a bored hole wall, said axis of rotation being oriented substantially perpendicular to the longitudinal axis of the drill string, and each of said wheel assemblies having a rotatable overload wheel means having a radius less than that of said compressible wheel means such that said overload wheel means is oriented against the bored hole wall upon substantial compression of said compressible wheel means.

16. The stabilizer of claim 15, wherein said plurality of wheel assemblies are six in number.

17. The stabilizer of claim 15, wherein each of said wheel assemblies is comprised of one overload wheel means between compressible wheel means.

18. The stabilizer of claim 15, further comprising removable leg extension means located between said stabilizer hub and each of said wheel assemblies.

19. The stabilizer of claim 15, further comprising a torque multiplier assembly in said stabilizer hub, said torque multiplier assembly comprising:

rotatable input shaft means attached to the drill string;

sun gear means meshed with said input shaft means;

planet gear means nested with said sun gear means and supported by planet carrier means;

ring gear means meshed with said planet gear means; and rotatable output shaft means whereby rotation of said input shaft means causes rotation of said output shaft means with torque greater than that of said input shaft means.

20. The stabilizer of claim 19, wherein said ring gear means is rotatable and is nested with said output shaft means, and said planet carrier means is not rotatable.

21. The stabilizer of claim 19, wherein said planet carrier means is rotatable and is meshed with said output shaft, and said ring gear means is not rotatable.

22. A weight assembly for a down reaming apparatus having a frame and a cutterhead rotatable relative to the frame and to said weight assembly, said weight assembly comprising:

a plurality of plates stacked in a plurality of layers;

each of said plates having a plurality of tie rod openings;

a plurality of tie rods adapted to be placed through said tie rod openings of said plates, at least one of said tie rods passing through all of said plates; and means for securing said tie rods to secure said plates on the frame of the rock boring apparatus such that loads from rotation of the cutterhead are transmitted through the frame and into said weight assembly.

23. The weight assembly of claim 22, wherein each of said plates includes an opening therethrough, each of said openings being oriented in each of said plates such that said openings are aligned to form a manway upon stacking of said plates.

24. The weight assembly of claim 22, wherein each of said plates is comprised of a plurality of wedge-shaped sections.

25. The weight assembly of claim 24, wherein said wedge-shaped sections of each layer of said plates are radially off-set from said wedge-shaped section of each adjoining layer of said plates.

26. The weight assembly of claim 22, wherein said means for securing said tie rods comprises:

a top weight clamp having tie rod openings therein, said top weight clamp adapted to be oriented above said plates;

a bottom weight clamp having tie rod openings therein, said bottom weight clamp adapted to be oriented below said plates and to fixedly hold an end of each of said threads; and jack means attached to said tie rods such that said tie rods are oriented through said tie rod openings of said plates, said top weight clamp and said bottom weight clamp, and said jack means applies a compressive force against said plates to secure said plates on the frame of the rock boring apparatus.

27. A stabilizer for a down reaming apparatus having a cutterhead, said stabilizer comprising:

a stabilizer hub having an inner race attached to the cutterhead and an outer race rotatable with respect to said inner race; and a plurality of wheel assemblies radially attached to said stabilizer hub, each of said wheel assemblies having a rotatable wheel on a wheel support and a compressible bumper between said wheel support and said stabilizer hub, said wheel support being pivotally connected to said stabilizer hub whereby reaction of said rotatable wheel against a bored hole wall causes pivotal movement of said wheel support against said compressible bumper.

28. The stabilizer of claim 27, wherein said plurality of wheel assemblies are five in number.

* * * * *